United States Patent [19]

Goins

[11] 4,281,776

[45] Aug. 4, 1981

[54] PROPORTIONAL FEEDER FOR PARTICULATE SOLIDS

[75] Inventor: Robert R. Goins, Bartlesville, Okla.

[73] Assignee: Phillips Petroleum Co., Bartlesville, Okla.

[21] Appl. No.: 39,404

[22] Filed: May 15, 1979

Related U.S. Application Data

[63] Continuation of Ser. No. 811,358, Jun. 29, 1977, abandoned, which is a continuation-in-part of Ser. No. 658,569, Feb. 17, 1976, abandoned, which is a continuation of Ser. No. 525,862, Nov. 21, 1974, abandoned, which is a continuation-in-part of Ser. No. 452,922, Mar. 20, 1974, abandoned.

[51] Int. Cl.[3] ..... B67D 5/60

[52] U.S. Cl. ..... 222/132; 222/134; 222/145; 193/31 R

[58] Field of Search ..... 222/129, 132, 134, 145, 222/460, 462; 137/625.4, 625.48; 193/31 R; 366/160, 162; 425/130, 131.1

[56] References Cited

U.S. PATENT DOCUMENTS

| | | | |
|---|---|---|---|
| 486,919 | 11/1892 | Winget | 222/129 X |
| 3,174,652 | 3/1965 | Villemure | 222/132 |
| 3,479,206 | 11/1969 | Patterson | 222/2 X |
| 3,575,321 | 4/1971 | Fisher | 222/145 |
| 3,743,143 | 7/1973 | Barney et al. | 222/145 |

FOREIGN PATENT DOCUMENTS

| | | | |
|---|---|---|---|
| 935238 | 11/1955 | Fed. Rep. of Germany | 222/145 |

*Primary Examiner*—Charles A. Marmor

[57] ABSTRACT

Proportional feeders for particulate solids such as plastic pellets, powders and the like, with precise control over the ratio of one material to another comprising, in combination, at least one housing having a vertical upper portion of uniform cross section and an inwardly converging lower portion, at least two inlets in the upper portion, an outlet in the lower portion and a vertical, laterally adjustable separator between the inlets in each housing and an adjustable wall member in at least one housing.

18 Claims, 7 Drawing Figures

PROPORTIONAL FEEDER FOR PARTICULATE SOLIDS

This is a continuation of application Ser. No. 811,358, filed June 29, 1977, now abandoned, which is a continuation-in-part of application Ser. No. 658,569, filed Feb. 17, 1976, now abandoned, which is a continuation of application Ser. No. 525,862, filed Nov. 21, 1974, now abandoned, which was a continuation-in-part of application Ser. No. 452,922, filed Mar. 20, 1974, now abandoned.

This invention relates to an apparatus for feeding of particulate solids.

Many applications for plastic materials require the use of colorants. Such colorants can be dyes, organic pigments and inorganic pigments. Colorants can be in the form of dry powders or they can be concentrates with a high loading of color in the polymer used.

Of the methods used to color a plastic material, one of the simplest is barrel blending, wherein a measured portion of colorant is admixed by tumbling with a measured portion of natural (uncolored) plastic material. Barrel blending, however, is not well adapted to large-volume applcations. Such large-volume blending applications generally utilize large tank blenders wherein measured portions of materials to be blended are placed in the tank blender and material is withdrawn from the tank at a plurality of sampling points so designed as to provide a uniform mixture of particles. Single pass blending is usually not realized in practice due in large part to inherent differences in the natural materials and color concentrates. The difference in pellet size, shape, bulk density and the like generally dictate that such blenders be operated as recylce blenders rather than as single pass blenders. Operation of such blenders as recycle blenders converts such operation from continuous to batch.

Where blending is performed in batch fashion, the blended materials must be stored until they are utilized by the processing (molding, spinning, etc.) machinery.

Direct proportionate feed from the storage facility to the processing machinery can be accomplished by the use of weigh belt feeder systems. The simplest such system involves a natural pellet storage hopper and a color concentrate pellet storage hopper with each hopper having its own weigh belt conveyor. The two conveyors discharge into a common receptacle, as for example, the feed hopper of an extruder. Such systems offer many advantages over batch handling systems. The pellet admixture is not stored or held for any appreciable length of time; therefore, there is little chance that the pellets will segregate. Control over the relative amounts of color concentrate and natural material is generally precise; however, such systems are not without drawbacks. They can be expensive and maintenance and repair costs can be high.

Historically, as customer demands for better control of color level have increased, the processor has employed more expensive, more complicated control equipment, rather than seek out less expensive, less complicated equipment.

It is therefore an object of this invention to provide a improved apparatus for the proportionate feeding of particulate solids.

Other objects, aspects and advantages of the present invention will become apparent from the following description and accompanying drawing of which FIG. 1 is a perspective view of the proportional feeder of this invention, portions of the apparatus being shown broken away;

In accordance with one presently preferred aspect of the present invention, there is provided a proportional feeder for particulate solids which comprises, in combination, a housing having a vertical upper portion and an inwardly converging lower portion and an unobstructed chamber extending therethrough, first and second inlet means vertically disposed in the upper portion of said housing each having first and second ends, the second ends of each such inlet means being in communication with said unobstructed chamber; separating means disposed between the inlet means to separate the second ends of each inlet means and to divide the area of the upper portion of said unobstructed chamber adjacent the second end of said inlet means into first and second zones, and outlet means disposed in the lower portion of said converging lower portion and in communication with said unobstructed chamber.

In one embodiment of this invention, the separating means is laterally adjustable between the inlet means, thereby providing for adjustment of the relative areas of the first and second zones.

In a presently preferred embodiment, the laterally adjustable separating means has in association therewith adjusting means.

In another embodiment of this invention the upper portion of the vertical housing is of substantially uniform cross-section and outlet means is disposed in the lower end of the inwardly converging lower portion with flow regulating means in association therewith.

In yet another embodiment of this invention, the separating means is laterally adjustable between the inlet means and is disposed substantially vertically within the chamber.

In a further embodiment of this invention, there is provided a novel multichambered proportional feeder for particulate solids having adjustable means in association with one of the chambers for the proportional feeding of a further particulate solid material without disturbing the relative proportions of the other particulate solids present in the chamber with which the adjustable means is associated.

Figure 1:
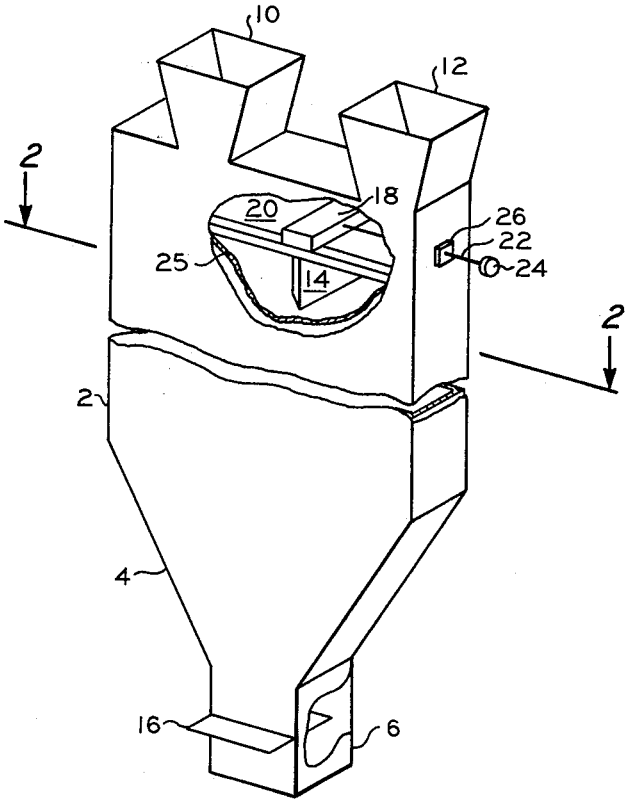

In general and as shown in FIG. 1, the proportional feeder of this invention comprises a housing 2 having a vertical upper portion and a converging lower portion 4 and an unobstructed chamber extending therethrough. First inlet means 10 and second inlet means 12 disposed in the upper portion of said housing 2 with each having first and second ends, the second ends of each inlet means being in communication with the unobstructed chamber within the housing 2; separating means 14 is disposed between the inlet means 10 and 12 thus dividing the upper area of the vertical portion of housing 2 adjacent the second end of each of the inlet means into a first and second zone. The converging lower portion 4 having an upper end and a lower end with the upper end being adjacent the lower end of the lower portion of the vertical portion of housing 2 and in open communication with the unobstructed chamber extending therethrough and outlet means consisting of a vertically disposed housing extending below the terminus of the converging portion 4 of housing 2 and in communication with the unobstructed chamber extending through the housing 2. Outlet means 6 is further provided with a flow regulating means such as slide valve 16.

Figure 2:
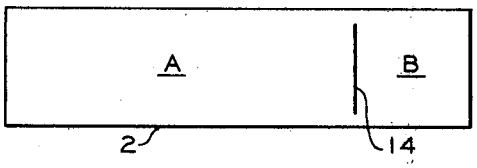
FIG. 2 is a cross-sectional view through section 2—2 of FIG. 1.

In one embodiment of this invention, separating means 14 is adjustable, laterally, between inlet means 10 and 12, thereby varying the relative cross-sectional areas of the two zones, A and B, in the upper portion of housing 2, as shown in FIG. 2. Shown in association with separating means 14 are support means and adjusting means. The support means comprises a support block 18 to which means 14 is attached and support rails 20 on which block 18 rests. The adjusting means comprise connecting means 22, knob 24 and locking means 26.

In operation, pellets are supplied to the proportional feeder from storage means, not shown, via transfer means, not shown, through inlet means 10 and 12 into the chamber formed by housing 2. The feeder is supplied with natural pellets through inlet means 10 and color concentrate pellets through inlet means 12.

In starting up, flow means 16 is closed and the feeder is filled with natural pellets through inlet means 10. When the feeder is filled with natural pellets, color concentrate pellets are thereafter supplied to the feeder through inlet means 12. Flow means 16 is then opened and the natural and color concentrate pellets pass through the feeder by gravity flow. The flow rate through outlet means 6 must be no greater than the combined flow capacity into inlet means 10 and 12. Thus, under normal operating conditions, the limiting flow rate through outlet means 6 will cause the proportional feeder to be continuously full. Under conditions which keep the feeder filled, it has been observed that material in any cross-sectional area across the vertical housing below the separating means will flow uniformly downward therethrough. Thus, the stream of pellets passing through outlet means 6 will contain natural and color pellets in a ratio in proportion to the ratio of the areas of zones one and two as determined by the position of separating means 14.

The length of the chamber formed by the vertical housing below separating means 14 is critical only to the extent that such chamber must be of sufficient length that the downward rate of flow of each material is uniform at the lower edge of the separating means through the chamber. In general, the length of the vertical chamber is at least equal to the greatest cross-sectional dimension in any horizontal plane across housing 2.

The proportional feeder of this invention can have any convenient cross-sectional shape. The feeder can be rectangular, circular or triangular. The separating means can be a vertical separating plate, as shown in FIGS. 1–5, or it can be a conduit of appropriate size to provide the desired proportioning of particulate materials. In one embodiment, the feeder is rectangular in cross-section, with a width to depth ratio in the range of 1:1 to 9:1.

Separating means 14 is positioned within and extends across the upper portion of housing 2 below inlet means 10 and 12. The vertical length of separating means 14 is determined by the depth of the valley created by the intersection of the upper solid surfaces of adjacent particulate solids when the feeder is filled with particulate solids when the separating means is not present. The separating means should be of sufficient length to extend at least to a minimum point or distance below such valley as would otherwise form in the absence of the separating means when the feeder is filled with solid particulate materials in order that the solids can "pack", thus avoiding turbulence at the trailing edge of the separating plate as the materials progress downwardly. In general, the vertical length of separating means 14 below inlet means 10 and 12 is on the order of from 0.2 to 0.3 times the greatest cross-sectional dimension in any horizontal plane across housing 2.

In one embodiment, separating means 14 is fabricated of a thin sheet material such as stainless steel, and the lower edge of separating means 14 can be beveled to a knife edge, in order to avoid turbulence of the material at the trailing edge of the separating means. In a presently preferred embodiment, the lower edge of separating means 14 is beveled on one side only and the beveled side is disposed facing the zone of greater material flow, i.e., the zone of greater area.

Figure 3:
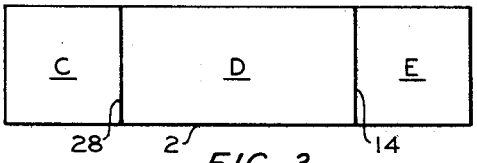
FIGS. 3–5 are cross-sectional views through section 2—2 of hereinafter described embodiments of this invention.

In another aspect of this invention, the proportional feeder can have more than two inlet means, with the proviso that there be a separating means between adjacent pair of inlet means. Thus, in one embodiment of this invention, as shown in FIG. 3, there is provided a proportional feeder having three inlet means (not shown) corresponding to each of the three zones C, D and E and two separating means 14 and 28. One inlet is provided for natural pellets, one for color concentrate pellets and one for an additive. The separating means 14 between the natural and color concentrate inlets is adjustable, thus providing for adjustment of the natural:-color ratio. The separating means 28 between the additive and natural inlets can be adjustable or fixed. In an application where the natural:additive ratio is constant, the separating means 28 is fixed in a predetermined position.

Figure 4:
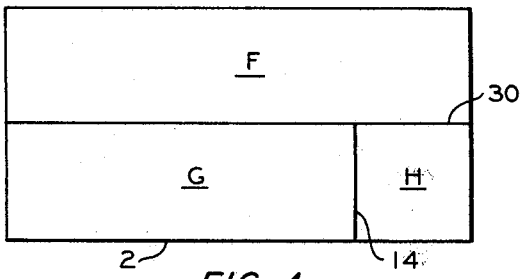

The fixed separating means can also be arranged as shown in FIG. 4 which illustrates a proportional feeder having three inlet means corresponding to the zones F, G, and H, a fixed separating means 30 and an adjustable separating means 14.

Figure 5:
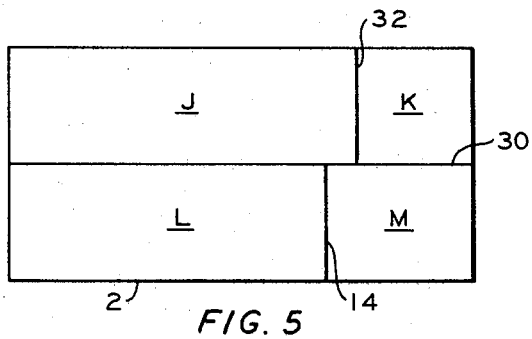

In the embodiment as shown in FIG. 5, the proportional feeder can have inlet means (not shown) for each of the four zones J, K, L and M. A fixed separating means 30 divides the upper portion of housing 2 into two zones wherein the ratio (J+K):(L+M) is constant and wherein the ratios J:K and L:M are fixed or variable according to whether the separating means 32 and 14, respectively, are fixed or variable.

The proportional feeder of this invention is generally adapted for use in dispensing particulate solids such as plastic pellets, powders and the like, with precise control over the ratio of one material to another.

The proportional feeder of this invention provides proportional control over the materials being fed in the range of 2:1 to 10:1. Larger feed ratios, as for example 100:1, can be employed; however, such ratios are limited by pellet size and shape and the particular materials being fed. Where large feed ratios are desired, two or more proportional feeder units can be used in series. Thus, for example, where a ratio of 99 parts of natural to 1 part of color concentrate is desired, two units providing feed ratios of 9:1 can be used in series, with the first unit feeding the lesser material inlet of the second unit.

Figure 6:
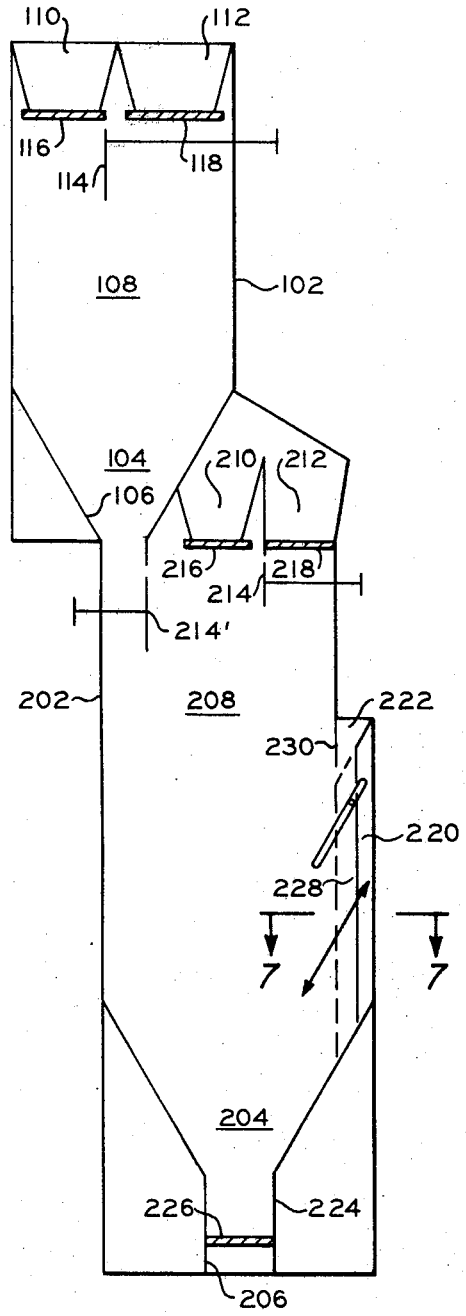
FIGS. 6 and 7 are views of a further particulate feeder in accordance with the invention modified by the addition of a side wall inlet means.

In a further embodiment of the invention, as shown in FIG. 6, two proportional feeders of the type described in connection with FIG. 1 are provided in series with the side wall of the lower feeder unit being so adjustably modified that a further particulate solid can be proportionally introduced into the lower feeder 202 without disturbing the relative proportion of the other material present in the lower feeder. Referring to FIG. 6, the apparatus comprises a first proportional feeder 102 having a lower portion 104 with converging walls, outlet means 106 in the converging lower portion 104, inlet means 110 and inlet 112 in the vertical upper portion 108, and adjustable separating means 114 positioned between and below inlet means 110 and 112, thereby dividing the upper portion 108 of feeder 102 into two zones. Outlet means 106 is in open communication with the interior chamber 208 of the second proportioning feeder unit 202. Separating means 114 is adjustable laterally between inlet means 110 and 112. Slide valve means 116 and 118 are disposed in inlet means 110 and 112 to control the flow of material through each inlet. The separating means can be mounted on adjusting means as illustrated in FIG. 1.

Second proportional feeder unit 202 is similar to feeder 102 and thus comprises a converging lower portion 204, outlet means 206 in the lower portion, inlet means 210 and 212 in the vertical upper portion 208 along with outlet means 106 of feeder 102 and separating means 214 and 214' positioned between and below inlet means 210, 212 and 106, thereby dividing the upper portion 208 of feeder 202 into three zones. Outlet means 206 is provided with flow regulating means 226. Separating means 214 and 214' are adjustable laterally between inlet means 210, 212 and 106. Slide valve means 216 and 218 are disposed in inlet means 210 and 212 to control the flow of materials through each inlet. The separating means can each be mounted on separate adjusting means as illustrated in FIG. 1.

Figure 7:
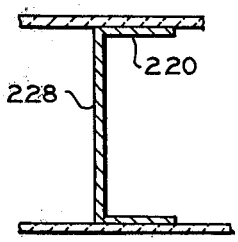

In addition, second feeder unit 202 is provided with a slidably adjustable wall section 220. The bottom of wall section 220 is adapted to be movable along the converging wall surface of wall section 224 in the direction indicated by the inclined arrow appearing in FIG. 6. When so displaced, wall 220 in combination with the abutting walls (as illustrated in FIG. 6 and the cross-sectional view thereof in FIG. 7 along line 7) forms an inlet 222 through which additional feed can be effected without altering the relative proportions of the other materials already in the system. Preferably wall 220 is adapted to move 0 to 0.3 times the width of the feeder unit 202. Such an inlet means thus provides a convenient means of recycling reground materials. When inlet means 222 is not required, the movable wall 220 can be returned to a position whereby the interior surface 228 thereof is in line with the interior surface 230 of upper portion 208.

In addition, in the area proximate valve means 226 is provided a hinged wall section 224 which provides access to the valve means 226 and interior of the second feeder 202 and outlet 206 when required.

In operation, the initial materials are provided in a manner similar to that previously described for the single unit feeder of FIG. 1. Thus, following initial filling of the system, changes in relative proportions can be effected by appropriate adjustment of the various separation means 114, 214 and 214'.

Relative dimensions of each unit 102 and 202 of the apparatus of FIG. 6 are similar to those provided for the single unit 2 of FIG. 1.

When additional particulate feed is to be introduced into inlet 222, feed rates from about 10 to 30 percent of flow rate in 208 above inlet 222 can be utilized.

When particulate materials are to be introduced to the system, only inlet means 222 should be employed for introduction of the material in order to avoid changing the ratio of components already in the system.

As a still further embodiment of the invention, the feeder of FIG. 1 can be modified to provide a movable wall member and inlet such as provided in the lower unit 202 of the apparatus of FIG. 6.

The proportional feeders of this invention can be positioned directly over the feed hopper of an extruder. If desired, a pellet blender can be positioned between the proportional feeder and the extruder feed hopper. Alternatively, the outlet stream of the proportional feeder can discharge to an air conveyor system which carries the pellets to the extruder feed hopper.

Housing 2, 102 or 202 can be fabricated from any suitable material. Examples of materials which can be used to fabricate the housing include aluminum, steel, glass, polyacrylic sheet and the like, as well as combinations thereof.

The inner sufaces of the feeders of this invention, i.e., the surfaces in contact with the materials being fed, should not provide any impediment to downward flow of the solid materials. If desired, the inner surfaces can be coated or covered with a low-friction material such as polyethylene, poly(phenylene sulfide), polytetrafluoroethylene and the like as shown in FIG. 1. (25).

Reasonable variations and modifications are possible within the scope of this disclosure without departing from the scope and spirit thereof.

I claim:

1. A proportional feeder for particulate solids comprising in combination:

a housing having a vertically disposed upper portion and an inwardly converging lower portion with an unobstructed chamber extending therethrough;

at least two inlet means vertically disposed in said vertically disposed upper portion, each inlet means having a first end and a second end with each of said second ends being in communication with the upper end of said unobstructed chamber;

at least one separating means vertically disposed in the upper end of said unobstructed chamber and so positioned as to divide the cross-sectional area of said upper portion of said unobstructed chamber adjacent the second ends of said inlet means into at least two zones, at least one of said vertical means being laterally adjustable between said inlet means, thereby varying the relative areas of said zones as measured at the lower end of said separating means;

an outlet means disposed in the lower portion of said inwardly converging portion of said housing and in communication with said unobstructed chamber and so adapted as to provide a flow of particulate solids therethrough at a rate not greater than the combined rates of flow through said inlet means;

wherein said separating means is of such a vertical length that it extends at least a minimum distance below the valley which would otherwise be created in the absence of said separating means by the intersection of the upper solids surface of adjacent particulate solids introduced through said inlet means when said feeder is filled with particulate solids such that the solids avoid turbulence at the trailing edge of said separating means as the solids progress downwardly through the remaining section of said upper portion of said vertically disposed housing extending below said separating means; and wherein the section of said upper vertically disposed portion of said housing which extends downwardly below the point of termination of said separating means is of a length which is sufficient to establish flow uniformly downward of solids from each of said zones in the upper section of said unobstructed chamber as defined by said separating means.

2. A proportional feeder according to claim 1 wherein said housing is substantially uniform and rectangular in cross section.

3. A proportional feeder according to claim 2 wherein said outlet means is disposed in a vertically disposed housing extending downward from the point of termination of said inwardly converging portion of said housing and in communication with said unobstructed chamber.

4. A proportional feeder according to claim 1 wherein said outlet means has flow-regulating means in association therewith, said flow-regulating means adapted for continuous flow of said particulate solids when opened.

5. A proportional feeder according to claim 3 wherein said separating means has support means and adjusting and locking means in association therewith, said support means comprising a support member to which said separating means is attached and horizontal support means upon which said member rests.

6. A proportional feeder according to claim 1 having two inlet means and one adjustable separating means.

7. A proportional feeder according to claim 1 having four inlet means, two adjustable separating means and a single fixed separating means.

8. A proportional feeder according to claim 1 having three inlet means, one adjustable separating means and one fixed separating means.

9. A proportional feeder according to claim 1 having the inner surface thereof covered with a low-friction material.

10. A proportional feeder according to claim 1 wherein the length of said separating means is from about 0.2 to about 0.3 times the greatest cross-sectional dimension in any horizontal plane across the upper portion of said housing.

11. A proportional feeder according to claim 5 wherein said vertically disposed upper portion of said housing has a width to depth ratio in the range of 1:1 to 9:1 and wherein said unobstructed chamber has a vertical length which is at least equal to the greatest cross-sectional dimension in any horizontal plane across said housing.

12. An apparatus for proportionally feeding a plurality of solid particulate materials which comprises:

a first elongated vertical receiving and proportioning feeder having a vertical upper portion and a converging lower portion in open communication and essentially free of obstruction and which forms a stabilizing zone, first outlet means in said converging lower portion having a first end and a second end and having said first end in open communication with said converging lower portion, first inlet means for introducing a first particulate material into a first zone, second inlet means for introduction of a second particulate material into a second zone, separating means vertically disposed in said vertical upper portion of said first feeder and between said first and second inlet means to divide said vertical upper portion into a first feed-receiving zone and a second feed-receiving zone, said separating means being laterally adjustable between said first inlet means and said second inlet means;

a second elongated vertical receiving and proportioning feeder having a vertical upper portion and a converging lower portion in open communication and essentially free of obstruction, second outlet means in said converging lower portion of said second feeder, third inlet means into said vertical upper portion of said second feeder, fourth inlet means into said vertical upper portion of said second feeder and being further adapted so that the second end of said first outlet means of said first feeder is in open communication with the vertical upper portion of said second feeder, second separating means vertically disposed within said second feeder between each of said third and fourth inlet means and said first outlet means of said first feeder to divide said vertical upper portion into a third feed-receiving zone, a fourth feed-receiving zone and a fifth feed-receiving zone, said second separating means being laterally adjustable between said third inlet means, said fourth inlet means and the first outlet means of said first feeder;

flow control means to regulate the flow of solids through said outlet means of said second elongated vertical receiving and proportioning feeder; and fifth inlet means for introducing particulate solids into said second elongated feeder, said fifth inlet means being so adapted in said second feeder that particulate solids introduced into said feeder do not vary the relative proportion of particulate materials in said third, fourth and fifth feed zones.

13. An apparatus according to claim 12 wherein each of said vertical feeder is of rectangular configuration and said fifth inlet means is formed by one pair of side walls of said second feeder being outwardly extended to form the side walls of said fifth inlet means and a movable section of the wall of said second feeder between each of said side walls being outwardly movable within the area defined by said side walls in order to form, when so moved, a channel through which particulate solids can be introduced into the feeder.

14. The apparatus of claim 12 wherein said fifth inlet means is formed by a movable section of the vertical wall of said feeder which, when outwardly extended, forms an inlet for particulate solids into the interior of said second feeder and, when closed, the inner surface of which is in alignment with and conforms to the internal dimensions of the remaining portion of the wall adjacent said movable section.

15. The apparatus of claim 12 having means for introduction of a further material thereto without affecting the proportion of materials already within the chamber of said second feeder.

16. The apparatus of claim 12 wherein said means comprises a movable wall portion of said proportional feeder, said wall portion being adjustably mounted to move outwardly and upwardly in a direction parallel to the end walls of said feeder.

17. The apparatus of claim 12 wherein said movable wall portion can move from 0 to 0.3 times the width of said proportional feeder.

18. The apparatus of claim 12 wherein each of said separating means has the lower edge bevelled and the bevelled side is disposed facing the zone of greater area of said feed-receiving zones.

* * * * *